United States Patent [19]

Okada

[11] Patent Number: 4,704,946

[45] Date of Patent: Nov. 10, 1987

[54] FLUID MOTOR WITH ROTARY OUTPUT

[75] Inventor: Minoru Okada, Suita, Japan

[73] Assignee: Osaka Taiyu Co., Ltd., Osaka, Japan

[21] Appl. No.: 897,967

[22] Filed: Aug. 20, 1986

[51] Int. Cl.[4] ..... F01L 33/02; F15B 11/08

[52] U.S. Cl. ..... 91/7; 91/180; 91/188; 91/470

[58] Field of Search ..... 91/180, 183, 188, 470, 91/491, 7, 16; 417/519, 521; 137/624.14, 625.21, 625.23

[56] References Cited

U.S. PATENT DOCUMENTS

| | | | |
|---|---|---|---|
| 871,660 | 11/1907 | Andrews | 91/180 |
| 1,554,756 | 9/1925 | Peters . | |
| 1,989,212 | 1/1935 | Pascolini . | |
| 3,022,733 | 2/1962 | Krute . | |
| 4,094,227 | 6/1978 | King | 91/180 |
| 4,183,285 | 1/1980 | Stevenson . | |
| 4,286,500 | 9/1981 | Stevenson | 91/180 |

FOREIGN PATENT DOCUMENTS

| | | |
|---|---|---|
| 295078 | 11/1916 | Fed. Rep. of Germany . |
| 628024 | 3/1936 | Fed. Rep. of Germany . |
| 2947713 | 7/1981 | Fed. Rep. of Germany . |

*Primary Examiner*—Abraham Hershkovitz
*Assistant Examiner*—Mark A. Williamson
*Attorney, Agent, or Firm*—Armstrong, Nikaido, Marmelstein & Kubovcik

[57] ABSTRACT

A fluid motor for converting reciprocation of a piston within a cylinder to rotation by a crankshaft includes a valve for supplying a fluid to the cylinder and discharging the fluid therefrom. The valve comprises a rotary valve member rotatable with the crankshaft and a fixed valve body slidably in contact with the rotary valve member. When the motor stops, at least one-half portion of a fluid intake groove formed in the rotary valve member is positioned at one side, toward a direction opposite to the direction of rotation of the rotary valve member, of a position opposed to a cylinder connection port formed in the fixed valve body so that a sufficient amount of pressure fluid can be supplied to the cylinder at the start when the motor is initiated into operation again.

7 Claims, 14 Drawing Figures

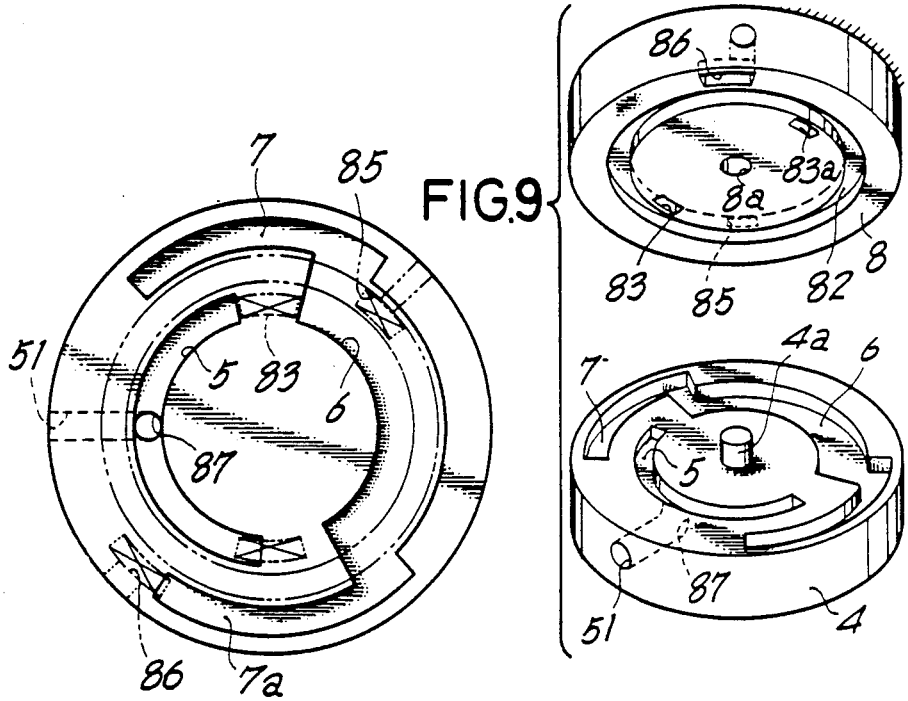
FIG.9
FIG.10
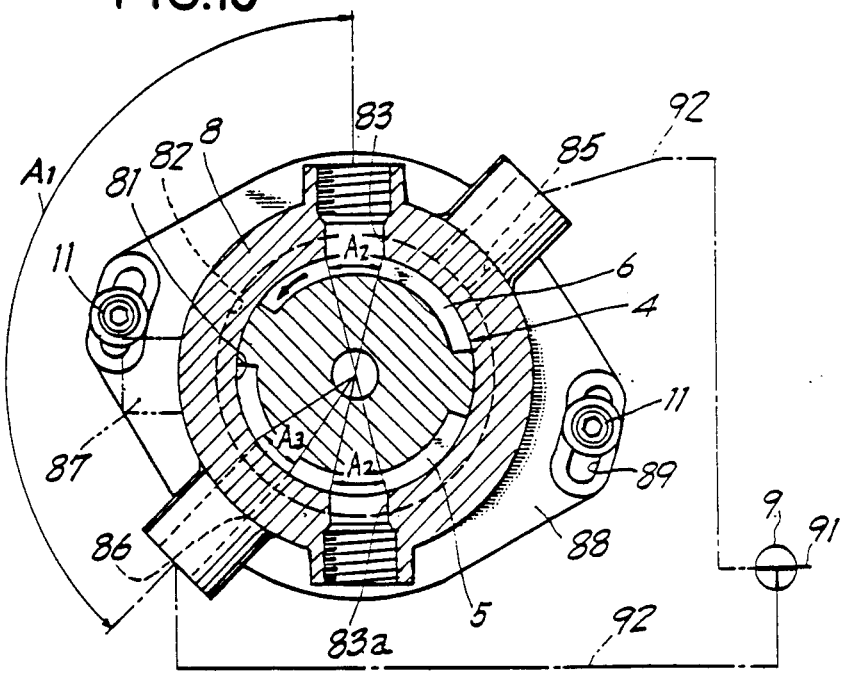
FIG.2

FIG.8 III

FLUID MOTOR WITH ROTARY OUTPUT

FIELD OF INDUSTRIAL APPLICATION

The present invention relates to fluid motors, such as air motors, having a single cylinder or two cylinders.

PRIOR ART AND PROBLEM THEREOF

Air motors used for converting the reciprocation of a piston within a cylinder to a rotary motion by a crankshaft are limited only to those having at least three cylinders.

This is due to the reason that with air motors having a single cylinder or opposed two cylinders, the crankpin 21 of the crankshaft 2 is likely to stop at the bottom dead point or top dead point as shown in FIG. 11, making it impossible to start up the motor again.

Motors having at least three cylinders are free of this problem since even if the piston in one cylinder stops at the top or bottom dead point, the other pistons are off the bottom dead point.

However, an increase in the number of cylinders increases the number of components of the entire motor to result in a higher cost and a greater energy loss due to the friction between the piston and the cylinder.

Further even when the piston stops at a position off the top or bottom dead point, it is impossible to start up the motor if a small amount of pressure fluid is supplied to the cylinder for start-up. This will be described in detail with reference to FIG. 12. Pressure air is supplied to and discharged from the cylinder by a rotary valve R. The valve comprises a rotary valve member 4 rotatable with a crankshaft 2 and a hollow cylindrical fixed valve body 8 having the valve member 4 rotatably fitted therein. The rotary valve member 4 is formed in its peripheral surface with an air intake groove 6 and an exhaust groove 5 which are alternately brought into communication with cylinder connecting ports 83, 83*a* formed in the fixed valve body 8. High-pressure air is supplied from the intake groove 6 to the cylinder 3 through an air intake channel (not shown) formed in the fixed valve casing 8, while the high-pressure air within a cylinder 3*a* is discharged therefrom via an exhaust channel (not shown) communicating with the exhaust groove 5. It is assumed that the crankshaft and the rotary valve member 4 stop at a position where the rear portion of the intake groove 6 with respect to the direction of rotation of the rotatary valve member 4 is opposed to the port 83 as shown in FIG. 12. When the motor is started again, the intake groove 6 of the rotary valve member 4 communicates with the port 83 only for a very short period of time, passing the port 83 in a moment, so that only a small amount of air is supplied to the cylinder via the intake groove 6. Whereas great energy is required for starting up the motor, the small amount of pressure air supplied to the cylinder 3 for start-up fails to initiate the motor into operation even if the piston is off the bottom or top dead center.

BRIEF DESCRIPTION OF THE DRAWINGS

FIG. 2 is a view in section showing details of a rotary valve member and a fixed valve body.

FIG. 9 is a perspective view of a rotary valve member and a fixed valve body each in the form of a disk;

FIG. 10 is a view showing the positions and angles of ports and grooves of the same;

MEANS FOR SOLVING THE PROBLEM

The present invention provides an epoch-making air motor which can be restarted smoothly irrespective of whether it has a single cylinder or two cylinders. The invention assures that a sufficient amount of pressure air can be supplied to the cylinder for restarting, further assuring that the piston will be spontaneously at rest at a position off the top or bottom dead point. While FIG. 2 shows a two-cylindered device having two ports 83 and 83*a* for connection to the cylinders, the port 83*a* is absent if the device has only one cylinder.

Figure 1:
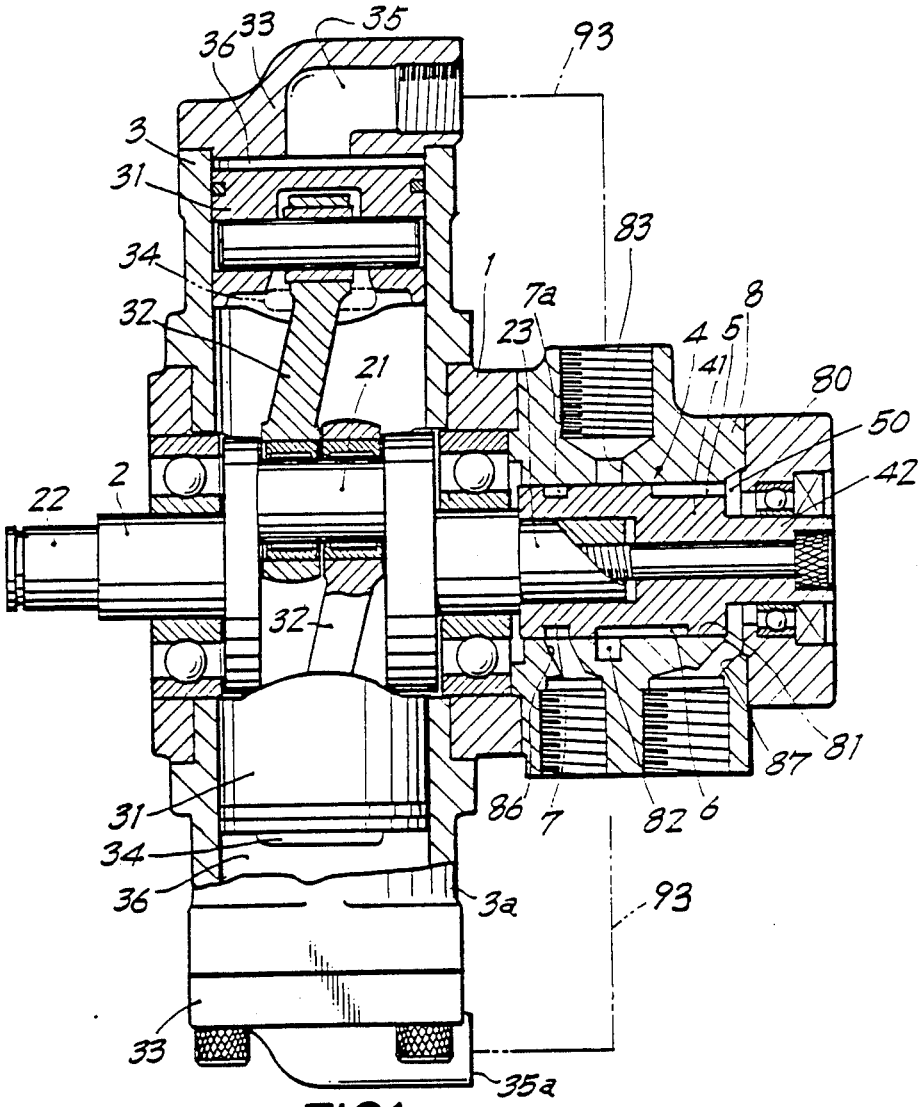
FIG. 1 is a sectional view showing an air motor.
Figure 12:
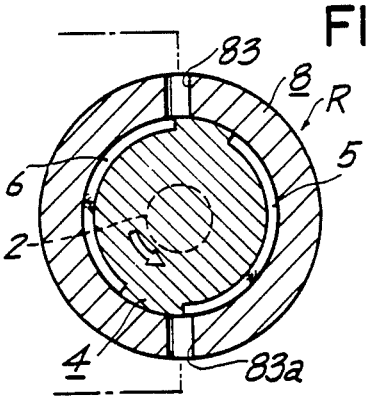
FIG. 12 is a sectional view of a rotary valve.
Figure 11:
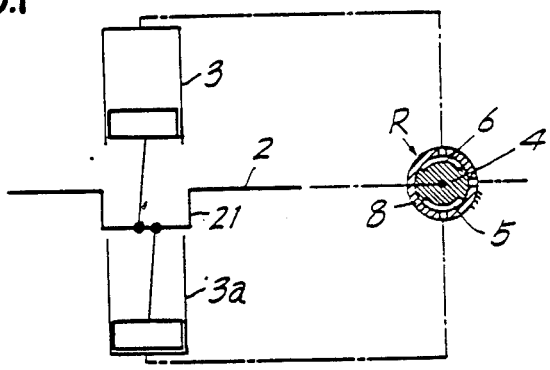
FIG. 11 is a diagram showing an arrangement of two cylinders opposed to each other with a crankshaft positioned therebetween to illustrate pistons in the two cylinders at the bottom or top dead point.

According to the present invention, a crankshaft 2 rotatable by the reciprocation of a piston 31 within a cylinder 3 has connected thereto a rotary valve member 4 rotatable with the shaft 2 as seen in FIG. 1. A fixed valve body 8 is fastened to a casing independently of the rotation of the rotary valve member 4. The rotary valve member 4 is slidable in contact with the fixed valve body 8. The fixed valve body 8 is provided with an air intake main port 85, an air intake subport 86 and the cylinder connection ports 83, 83*a*.

The rotary valve member 4 is formed in its sliding surface with an exhaust groove 5, an air intake groove 6 and an auxiliary groove 7 in communication with the intake groove 6.

When positioned as opposed to the cylinder connection port 83, the intake groove 6 permits the port 83 to communicate with the intake main port 85. The exhaust groove 5 is in communication with an exhaust channel 50 formed in the valve. When positioned as opposed to the cylinder connection port 83, the exhaust groove 5 permits the port 83 to communicate with the exhaust channel 50.

The auxiliary groove 7 and the intake subport 86 are so positioned relative to each other that when the rear portion (with respect to the direction of rotation of the valve member 4) of the intake groove 6 is opposed to the port 83, the auxiliary groove 7 communicates with the intake subport 86.

The intake groove 6 and the piston 31 in the cylinder 3 are so positioned relative to each other that when the front to middle portion (with respect to the direction of rotation of the valve member 4) of the intake groove 6 is opposed to the cylinder connection port 83, the piston 31 is off the top dead point or bottom dead point.

The terms "front portion" and "rear portion" as used herein refer to the position with respect to the direction of rotation of the element concerned.

OPERATION

While high-pressure air is supplied via the intake main port 85 and the intake subport 86, a smaller amount of high-pressure air is supplied through the subport 86 than through the main port 85.

When the intake groove 6 of the rotary valve member 4 is in communication with the cylinder connection port 83, the high-pressure air sent through the intake main port 85 flows into the cylinder 3 via the port 83, pushing the piston 31 to rotate the crankshaft 2.

The rotation of the crankshaft 2 rotates the rotary valve member 4 with the shaft 2. The air is discharged from the cylinder 3 when the exhaust groove 5 of the valve member 4 is subsequently brought to the position opposed to the port 83.

In this way, the intake groove 6 and the exhaust groove 5 are alternately brought into communication with the port 83 by the rotary valve member 4 rotating with the crankshaft 2, whereby air is supplied to and discharged from the cylinder 3 to drivingly rotate the crankshaft 2.

The motor can be stopped by discontinuing the supply of high-pressure air to the intake port 85 while continuing the air supply to the intake subport 86. The supply of high-pressure air through the intake subport 86 only fails to sustain the rotation of the crankshaft 2, permitting the motor to come to a stop.

When the rotary valve member 4 spontaneously comes to a halt at a position where the front to middle portion of the intake groove 6 of the valve member 4 is opposed to the intake main port 85, the supply of the pressure fluid for restarting the motor will involve no problem.

Nevertheless, if the rotary valve member 4 spontaneously stops at a position where the rear portion of the intake groove 6 is opposed to the intake main port 85, the period of time for supplying the pressure air to the cylinder 3 via the intake groove 6 for restarting is short, and the small amount of pressure air fails to start up the motor again as already stated.

According to the present invention, however, when the supply of pressure air from the main port 85 is discontinued with the rear portion of the intake groove 6 in communication with the intake main port 85, the auxiliary groove 7 is in communication with the intake subport 86, from which high-pressure air is supplied to the cylinder connection port 83 via the auxiliary groove 7 and the intake groove 6. (In this state, the piston 31 is off the top or bottom dead point.) This holds the piston 31 in motion to continuously rotate the crankshaft 2 and the rotary valve member 4. The rotation of the rotary valve member 4 moves the intake groove 6 past the port 83. Although the supply of pressure air from the intake subport 86 is insufficient to maintain the rotation of the crankshaft 2 and the rotary valve member 4, a force of inertia acts on the crankshaft 2 and the valve member 4, with the result that the crankshaft 2 and the valve body 4 slightly rotate without stopping the moment when the intake groove 6 has passed the port 83. The shaft and the valve body come to a halt at the position where the front to middle portion of the intake groove 6 is opposed to the port 83. The rotary valve member 4 is so attached to the crankshaft that the piston 31 is off the top or bottom dead point at this time. The motor can therefore be started up again without any trouble.

ADVANTAGES

As compared with the conventional air motor having three or more cylinders, the present air motor, which is single- or two-cylindered, can be smaller in the number of components in corresponding relation to the reduction in the number of cylinders, while the energy loss due to the friction between the piston and the cylinder is also smaller.

EMBODIMENTS

First Embodiment (FIGS. 1 to 8)

These drawings show a two-cylindered air motor embodying the present invention.

A crankshaft 2 extending through a box-shaped casing 1 is supported at its opposite ends by the casing. First and second cylinders 3, **3*a* opposed to each other are attached to the casing 1, with the crankshaft 2** positioned between the cylinders.

Pistons 31, 31 slidably fitting in the cylinders 3, **3*a*, respectively, are connected to the crankshaft 2 by crank rods 32, 32**.

The cylinders 3, **3*a* have closures 33, 33 formed with intake-exhaust ports 35, 35*a***.

The cylinders 3, **3*a* are each formed with a slot 34 a small distance away from the bottom dead point of the piston 31. The intake-exhaust chambers 36, 36 of the cylinders 3, 3*a* communicate with the outside through the slots 34**.

The slot 34 extends circumferentially of the cylinder and serves the function of releasing backpressure from the chamber 36 when the piston 31 moved from the bottom dead point toward the top dead point to achieve an improved energy efficiency.

The crankshaft 2 has one end serving as an output shaft portion 22 and the other end serving as a valve mount portion 23. A rotary valve member 4 in the form of a hollow cylinder is fixed to the mount portion 23 so as to be rotatable with the crankshaft 2. The rotary valve member 4 comprises a large-diameter portion 41 fitting to the mount portion 23 of the shaft 2 and a small-diameter portion 42 projecting from the outer end of the large-diameter portion 41.

A cylindrical fixed valve body 8 having a bore 81 extending therethrough is fastened to the casing 1 by bolts 11. The rotary valve member 4 is fitted in the bore 81 hermetically and rotatably.

As seen in FIG. 2, the fastening bolt 11 extends through an arcuate slot 89 formed in a flange 88 on the fixed valve body 8. The valve body 8 is adjustable in phase by an amount corresponding to the amount of movement of the bolt 11 in the slot 89.

A closure 80 is attached to the open front end of the fixed valve body 8. An annular exhaust channel 50 is formed between the closure 80 and the small-diameter portion 42 of the rotary valve member 4.

The fixed valve body 8 is formed approximately at the axial midportion thereof with a circumferential groove 82 in the bore-defining inner surface thereof, the groove 82 extending over the entire circumference.

The fixed valve body 8 is further provided with an air intake main port 85, air intake subport 86, exhaust port 87 and two cylinder connection ports 83, **83*a*. All of these ports are in communication with the bore 81. The intake main port 85 communicates with the circumferential groove 82, and the exhaust port 87 with the exhaust channel 50**.

As shown in FIG. 2, the first cylinder connection port 83 and the second cylinder connection port 83*a* are away from each other by 180° about the axis of the valve, as diameterically opposed to each other.

According to the present embodiment, the intake subport 86 is away from the first cylinder connection port 83 and positioned close to the second cylinder connection port 83*a* as shown in FIG. 2. The subport 86 is closer to the crankpin 21 than the port 83*a* (FIG. 1).

The intake main port 85 communicates with the circumferential groove 82 extending over the entire circumference of the bore 81 of the fixed valve body 8, while the exhaust port 87 communicates with the exhaust channel 50 extending around the entire circumference of the small-diameter portion 42 of the rotary valve member 4, so that the intake port 85 and the exhaust port 87 can be at any position.

The intake main port 85 and the intake subport 86 communicate with a pressure air supply pipe 91 via a pipe channel 92 and a three-way valve 9.

By operating the three-way valve 9, pressure air can be supplied to the valve from both the intake ports 85, 86 at the same time, or from the intake subport 86 only.

The supply of pressure air to both ports 85, 86 can be discontinued. The intake subport 86 is smaller than the intake main port 85 in effective diameter. The amount of air intake via the subport 86 is smaller than the amount of air intake via the main port 85.

The first cylinder connection port 83 communicates with the intake-exhaust port 35 of the first cylinder 3 through a pipe channel 93, while the second cylinder connection port 83*a* communicates with the intake-exhaust port 35*a* of the second cylinder 3*a* via another pipe channel 93.

The exhaust port 87 is provided with a muffler (not shown).

The rotary valve member 4 is formed in its outer periphery with an air intake groove 6 and an exhaust groove 5 which are partly opposed to each other on opposite sides of the axis of the body.

The intake groove 6 brings the circumferential groove 82 of the fixed valve body 8 into communication with the ports 83 and 83*a* alternately, whereby the pressure air filling the groove 82 is supplied to the first and second cylinders 3 and 3*a* alternately via the intake groove 6 and the ports 83 and 83*a*.

The intake groove 6 is formed approximately in the middle of the large-diameter portion 41 of the rotary valve member 4 and has such a width W1 that the groove 6 overlaps the circumferential groove 82 and the ports 83, 83*a* of the fixed valve body 8.

In the following description, the circumferential groove length of the rotary member 4 is expressed in terms of the angle which the circumferentially opposite ends of the groove at the surface of the groove (i.e. at the interface between the rotary member and the fixed valve body) make about the axis of the rotary valve member unless otherwise specified.

Indicated at B1 is the angle the opposite ends of the intake groove 6 make about the axis. Indicated at A4 is the angle the opening edge of the port 83 and the opening edge of the port 83*a* make about the axis (see FIG. 8III). The angle B1 is slightly smaller than the angle A4, so that the intake groove 6 will not communicate with the two ports 83, 83*a* at the same time. The intake groove 6 is in communication with the circumferential groove 82 at all times. When the intake groove 6 is opposed to either one of the cylinder connection ports, the circumferential groove 82 communicates with the port, whereby the pressure air filling the groove 82 is supplied to the cylinder concerned.

The rotation of the rotary valve member 4 brings the exhaust groove 5 into communication with the first and second cylinder connection ports 83 and 83*a* alternately to exhaust air from the cylinders via the exhaust channel 50. The exhaust groove 5 has a width W2 from the front end of the large-diameter portion 41 of the rotary valve member 4, whereby the groove 5 is adapted to communicate with the cylinder connection ports. The circumferentially opposite ends of the exhaust groove 5 make an angle B2 about the axis. This angle B2 is slightly greater than the angle B1 made by the opposite ends of the intake groove 6. Consequently, the exhaust time for each cylinder is slightly longer than the air intake time.

Figure 5:
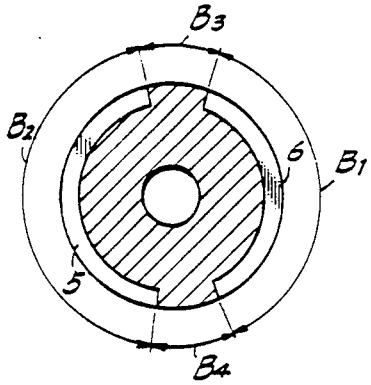
FIG. 5 is a view in section taken along the line V—V in FIG. 3.

The ends of the exhaust groove 5 and the ends of the intake groove 6 immediately adjacent to the former ends individually, make equal angles B3 and B4 about the axis (see FIG. 5). These angles B3 and B4 are also equal to angles A2 and A2 subtended by the openings of the ports 83, 83*a* at the center of the valve body (see FIG. 2).

The exhaust groove 5 does not communicate with the first and second cylinder connection ports 83, 83*a* at the same time. When the groove 5 is opposed to either one of these ports, the port communicates with the exhaust channel 50 through the groove 5.

The peripheral surface of the rotary valve member 4 is formed with first and second auxiliary grooves 7, 7*a* extending from the opposite ends of the exhaust groove 6. The first auxiliary groove 7 extends in the direction of rotation of the valve member 4, and the second auxiliary groove 7*a* in the opposite direction.

When the supply of pressure air to the intake main port 85 is discontinued, the auxiliary grooves 7, 7*a* serve to supply pressure air from the intake subport 86 to one of the first and second cylinders via the auxiliary groove and the intake groove 6 to rotate the crankshaft 2 to a position favorable for restarting.

The auxiliary grooves 7, 7*a* comprise axial groove portions 71, 71*a* extending from the intake groove 6 axially of the rotary valve member 4, and arcuate groove portions 72, 72*a* each extending from the axial groove portion circumferentially away from the other. The intake subport 86 is adapted for communication with the arcuate groove portions 72, 72*a*.

The opposite ends of the two arcuate groove portions 72, 72*a* make equal angles C1 and C2, respectively, about the axis.

Figure 6:
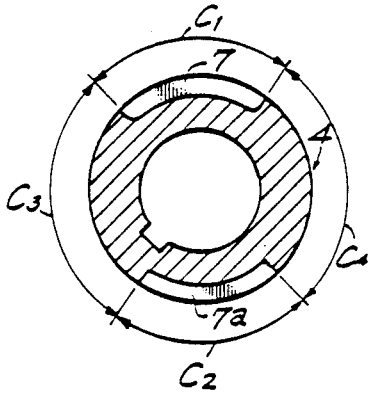
FIG. 6 is a view in section taken along the line VI—VI in FIG. 3.

The ends of the arcuate groove portion 72 and the ends of the arcuate groove portion 72*a* immediately adjacent to the former ends respectively, make equal angles C3 and C3 about the axis (see FIG. 6).

Figure 7:
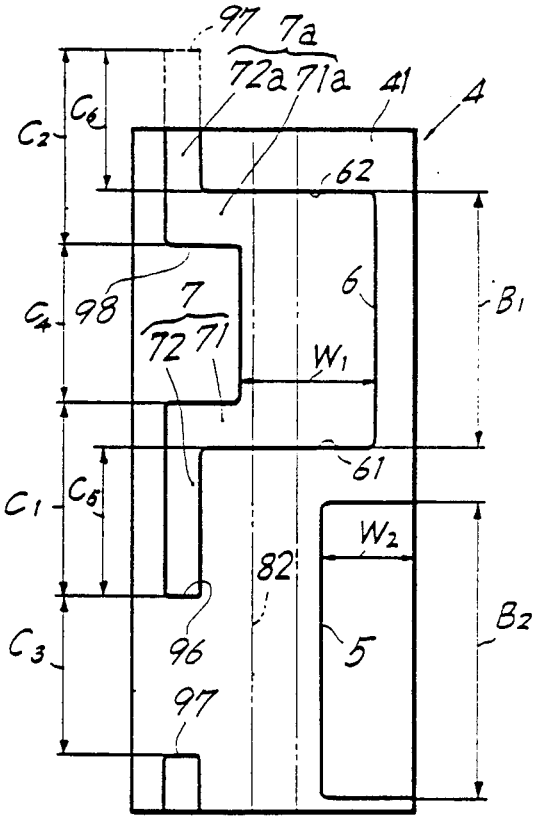
FIG. 7 is a development of the rotary valve member.

Further as seen in FIG. 7 which is a development of the rotary valve member 4, the forward end 96 of the arcuate groove portion 72 of the first auxiliary groove 7 and the front end 61 of the intake groove 6 make an angle C5 about the axis. Indicated at C6 is the angle made by the forward end 97 of the arcuate groove portion 72*a* of the second auxiliary groove 7*a* and the rear end 62 of the intake groove 6. C5 is slightly greater than C6.

The rotary valve member 4 and the crankpin 21 of the crankshaft 2 are in such phase relation that when the motor is to be started, the crankpin 21 is off the top or bottom dead point relative to the pistons 31 in the cylinders 3, 3*a*. According to the present embodiment, the crankpin 21 is positioned at an angle of 3° to 80° with respect to the pistons 31. Stated more specifically with reference to FIG. 8I, the rotary valve member 4 is attached to the crankshaft 2 to position the crankpin 21 as advanced from the piston 31 of the first cylinder 3 by an angle D1 of 3° about the axis of the valve body when the front end (with respect to the direction of rotation of the member 4) of the intake groove 6 is about to reach the first cylinder connection port 83.

Next with reference to FIGS. 8I to 8II, the relation of the grooves 5, 6, 7 and 7a of the rotary valve member 4 to the cylinder connection ports 83, 83a and the intake subport 86 will be described.

Figure 8I:
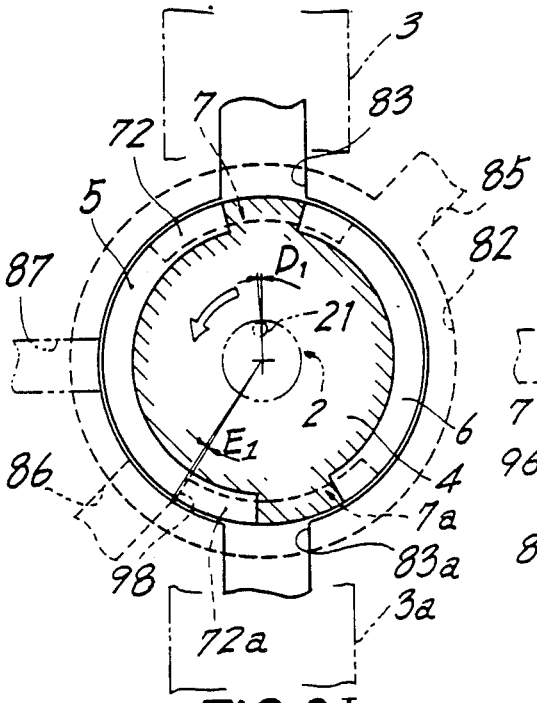
FIGS. 8I, 8II and 8III are views for illustrating the relation between ports of a fixed valve body and grooves of the rotary valve member.

FIG. 8I shows the valve with the crankpin 21 advanced by 3° from the piston of the first cylinder 3. In this state, the portion of the valve member 4 spacing the intake groove 6 from the exhaust groove 5 is opposed to the port 83, holding the port 83 out of communication with the grooves 6 and 5. The terminating end 98 of the arcuate groove 72a of the second auxiliary groove 7a has passed the intake subport 86 in the direction of rotation of the valve body 4 by a small angle E1.

Figure 8:
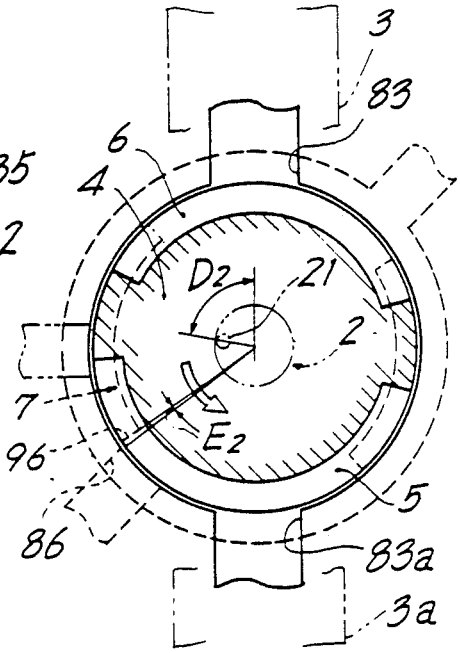
Figure 3:
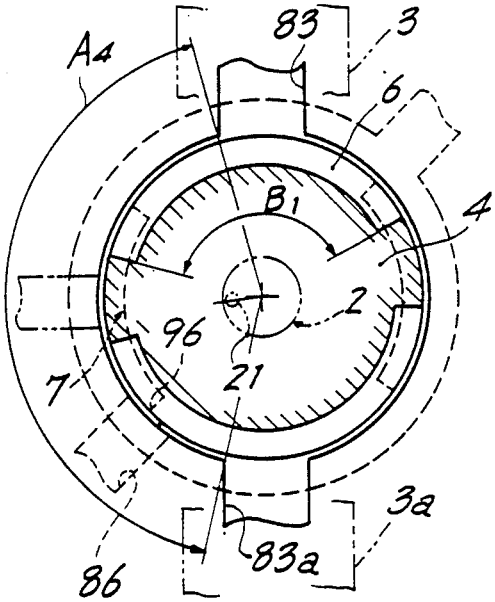
FIG. 3 is a side elevation of the rotary valve member.
Figure 3:
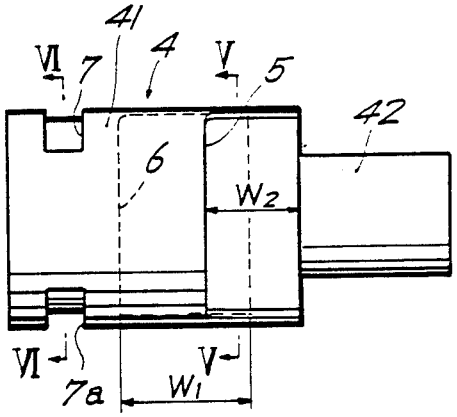
Figure 4:
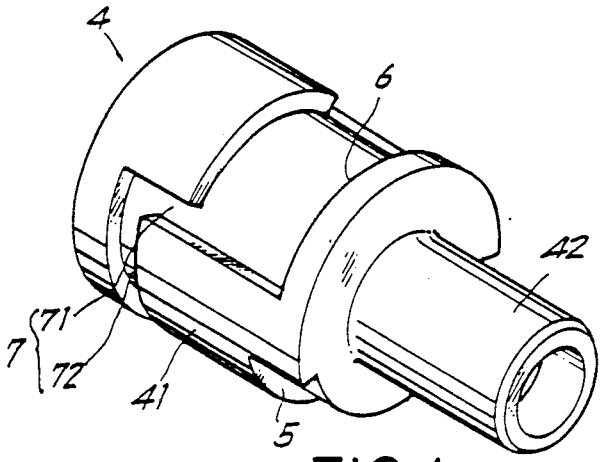
FIG. 4 is a perspective view of the rotary valve member.

FIG. 8II shows the valve when the crankpin 21 has advanced by an angle D2 of 80°, i.e. by 77° from the state of FIG. 8, with respect to the top dead point of the piston in the first cylinder 3.

The circumferential midpoint of the intake groove 6 is a small distance away from the center of the port 83 in the direction of rotation of the rotary valve member 4. Theforward end 96 of the first auxiliary groove 7 has to advance by a small angle E2 before reaching the intake subport 86.

FIG. 2 shows the position of the rotary valve member 4 relative to the fixed valve body 8 when the motor is to be started. The front to middle portion of the intake groove 6 is opposed to the first cylinder connection port 83.

For start-up, the three-way valve 9 is manipulated to supply pressure air to the intake main port 85 and the intake subport 86.

The supplied portions of pressure air join at the circumferential groove 82 of the fixed valve body 8, whereupon the air is passed through the intake groove 6 of the rotary valve member 4 and supplied to the ports 83, 83a and to the first and second cylinders 3, 3a alternately to rotate the crankshaft 2. In the meantime, the air is discharged from the cylinders 3, 3a via the exhaust groove 5 of the valve member 4 and the exhaust channel 50.

To stop the motor, the supply of pressure air to the intake main port 85 is discontinued by manipulating the three-way valve 9 while continuing the air supply to the intake subport 86 only. The motor stops owing to a reduction in the air supply.

After the piston 31 of the first cylinder 3 has reached the top dead center, the crankshaft 2 comes to a halt at an advanced position of 3° to 80° as shown in FIGS. 8I and 8II, with the result that the front to middle portion of the intake groove 6 is positioned as opposed to the first cylinder connection port 83.

Consequently, a sufficient period of time is available for the intake groove 6 to pass the port 83 to start up the motor. The pressure air can therefore be sent from the port 83 to the first cylinder 3 as required to initiate the crankshaft 2 into rotation.

When the intake groove 6 is similarly positioned relative to the second cylinder connection port 83a which is 180° away from the port 83 about the axis, pressure air can be supplied in an amount required for initiating the second cylinder 3a into operation.

In the state shown in FIG. 8III in which at least one-half of the length of the intake groove 6 has passed the port 83, the forward end 96 of the arcuate groove portion 72 of the first auxiliary groove 7 is in communication with the intake subport 86, so that the pressure air from the subport 86 is supplied to the first cylinder 3 through the first auxiliary groove 7, the intake groove 6 and the port 83 to rotate the crankshaft 2 and the rotary valve member 4. The crankshaft 2 is therefore unlikely to stop rotating while the intake groove 6 is in communication with the port 83 and the first auxiliary groove 7 with the intake subport 86.

With reference to FIG. 8III, the angle B1 is slightly smaller than the angle A4 shown. The intake groove 6, when stopping within the range of this angle A4, communicates with neither of ports 83, 83a, making the motor incapable of restarting. Nevertheless, the force of inertia acting on the rotary valve member 4 eliminates the likelihood that the intake groove portion 6 will stop upon passing the port 83 and be positioned between the two ports 83, 83a out of communication therewith.

When the rear portion of the intake groove 6 is opposed to the second cylinder connection port 83a, the second auxiliary groove 7a communicates with the intake subport 86, with the result that the pressure air from the suport 86 is supplied to the second cylinder 3a via the second auxiliary groove 7a, the intake groove 6 and the port 83a, driving the piston 31 in the second cylinder 3a to rotate the crankshaft 2.

Given below are specific values of the above-mentioned angles.

A1 135°, A2 31°, A3 19°, A4 149°, B1 136°, B2 162°, B3 31°, B4 31°, C1 80°, C2 80°, C3 100°, C4 100°, C5 63.5°, C6 60.5°, E1 0.5°, E2 0.5°

These angles are given for illustrative purposes only. The position and opening angle of the ports, and the position and angle of the grooves can be altered according to the diameter of the ports and difference in the timing of air intake and discharge.

The present invention described above obviates the likelihood that the portion of the rotary valve member 4 at the rear side of the intake groove 6 will stop at a position opposed to the port 83 or 83a, permitting the valve member 4 to stop with the front to middle portion of the intake groove 6 opposed to the port 83 or 83a. This makes it possible to supply a sufficient amount of pressure air to the cylinder at the start when the motor is re-initiated into operation, thus assuring smooth start-up.

Second Embodiment

A single-cylindered air motor is obtained by eliminating the second cylinder 3a and the second auxiliary groove 7a from the two-cylindered air motor described above.

The motor can be made to stop with the front to middle portion of the intake groove 6 opposed to the first cylinder connection port 83 as is the case with the foregoing embodiment, by maintaining a balance between the supply of pressure air from the intake support 86 and the force of inertia of the rotary valve member 4.

Third Embodiment (FIGS. 9 and 10)

As shown in FIG. 9, this embodiment comprises a rotary valve member 4 and a fixed valve body 8 each in the form of a disk. The rotary valve member 4 is hermetically fitted to the fixed valve body 8 and is rotatable in sliding contact therewith.

As in the foregoing embodiments, the fixed valve body 8 is formed in its sliding contact surface with a circumferential groove 82, first and second cylinder connection ports 83, 83*a*, intake main port 85 and intake subport 86.

The rotary valve member 4 is formed in its sliding surface with an intake groove 6, exhaust groove 5 and auxiliary grooves 7, 7*a*, each in the form of a circular arc. This embodiment is the same as the first in respect of the position relation between the ports 83, 83*a*, 85, 86 and 87 and the angles of the grooves 5, 6, 7 and 7*a*.

An exhaust channel 51 extends radially from the exhaust groove 5 to the outer periphery of the valve member 4. For positioning, a stud 4*a* projecting from the center of the rotary valve member 4 is rotatably fitted into a cavity 8*a* formed in the center of the fixed valve body 8.

Although air is used as the pressure fluid for the foregoing embodiments, other fluids such as hydraulic oil are of course usable.

What is claimed is:

1. A fluid motor wherein reciprocation of a piston within a cylinder is converted to rotation by a crankshaft and which includes a valve for supplying a fluid to the cylinder and discharging the fluid therefrom, the valve comprising a rotary valve member rotatable with the crankshaft and a fixed valve body slidably in contact with the rotary valve member, the fixed valve body being formed with a fluid intake main port, a fluid intake subport and a cylinder connection port, the cylinder connection port being in communication with an intake-discharge port of the cylinder, the rotary valve member being formed in its sliding contact surface with a fluid discharge groove, a fluid intake groove and an auxiliary groove communicating with the intake groove, the intake groove permitting the connection port to communicate with the intake main port when opposed to the port, the discharge groove being in communication with a fluid discharge channel formed in one or each of the rotary valve member and the fixed valve body, the discharge groove permitting the connection port to communicate with the discharge channel when opposed to the port, the auxiliary groove being so positioned relative to the intake subport as to communicate with the subport when the rear portion of the intake groove with respect to the direction of rotation of the rotary valve member is opposed to the connection port, the piston in the cylinder being so positioned relative to the intake groove as to be off the top dead point or bottom dead point when the front to middle portion of the intake groove with respect to the direction of rotation of the rotary valve member is opposed to the connection port.

2. A fluid motor as defined in claim 1 wherein the rotary valve member is generally in the form of a hollow cylinder and is formed in its outer peripheral surface with the discharge groove, the intake groove and the auxiliary groove, and the fixed valve body has a bore rotatably accommodating the rotary valve member therein and is formed in communication with the bore with the intake main port, the connection port and the intake subport.

3. A fluid motor as defined in claim 2 wherein the rotary valve member and the fixed valve body are arranged coaxially with each other, and the sliding contact surfaces of the valve member and body are cylindrical.

4. A fluid motor as defined in claim 2 wherein two fluid cylinders are arranged in opposed relation to each other, and the fixed valve body is provided with two cylinder connection ports spaced apart by 180° about the axis of the valve body, the ports being in communication with the cylinders respectively.

5. A fluid motor as defined in claim 1 wherein the rotary valve member and the fixed valve body are arranged coaxially with each other, and the sliding contact surfaces of the valve member and body are planar.

6. A fluid motor as defined in claim 1 wherein two fluid cylinders are arranged in opposed relation to each other, and the fixed valve body is provided with two cylinder connection ports spaced apart by 180° about the axis of the valve body, the ports being in communication with the cylinders respectively.

7. A fluid motor as defined in claim 1 wherein the fluid is a compressed air.

* * * * *